US009150990B2

(12) United States Patent
Goldman et al.

(10) Patent No.: US 9,150,990 B2
(45) Date of Patent: Oct. 6, 2015

(54) SYSTEMS, METHODS AND APPARATUS FOR EMBROIDERY THREAD COLOR MANAGEMENT

(71) Applicant: Vistaprint Schweiz GmbH, Winterthur (CH)

(72) Inventors: David A. Goldman, Endwell, NY (US); Nirav B. Patel, Binghamton, NY (US)

(73) Assignee: CIMPRESS SCHWEIZ GMBH, Winterthur (CH)

( * ) Notice: Subject to any disclaimer, the term of this patent is extended or adjusted under 35 U.S.C. 154(b) by 0 days.

(21) Appl. No.: 14/466,521

(22) Filed: Aug. 22, 2014

(65) Prior Publication Data

US 2014/0364988 A1 Dec. 11, 2014

Related U.S. Application Data

(63) Continuation of application No. 13/961,633, filed on Aug. 7, 2013, now Pat. No. 8,831,766, which is a continuation of application No. 13/446,739, filed on Apr. 13, 2012, now Pat. No. 8,515,572, which is a (Continued)

(51) Int. Cl.
*D05C 5/02* (2006.01)
*D05B 19/08* (2006.01)
*D05B 19/12* (2006.01)

(52) U.S. Cl.
CPC ..... *D05B 19/08* (2013.01); *D05B 19/12* (2013.01); *D05C 5/02* (2013.01)

(58) Field of Classification Search
CPC ..... D05B 19/02; D05B 19/04; D05B 19/08; D05B 19/10; D05B 19/12; D05C 5/00; D05C 5/02
USPC ..... 700/136–138; 112/470.01, 470.04
See application file for complete search history.

(56) References Cited

U.S. PATENT DOCUMENTS 4,369,722 A 1/1983 Nishida et al.
5,727,485 A 3/1998 Morita (Continued)

FOREIGN PATENT DOCUMENTS

WO 0050682 8/2000
WO 2009091838 7/2009

OTHER PUBLICATIONS

International Searching Authority, "International Search Report," issued in connection with counterpart international application No. PCT/US2009/031017, mailed Apr. 7, 2009, 2 pages.

(Continued)

*Primary Examiner* — Nathan Durham
(74) *Attorney, Agent, or Firm* — Hanley, Flight & Zimmerman, LLC

(57) ABSTRACT

Systems, methods, and apparatus for embroidery thread color management are disclosed. An example method comprises determining a set of thread colors needed for a set of embroidery designs including a first embroidery design and a second embroidery design, annotating the second embroidery design, the annotating comprising appending a reference to the second embroidery design in a first queue of designs to be embroidered by a first embroidery machine, and rolling back the annotation of the second embroidery design. The rolling back comprises removing the annotation, removing the reference, and removing a thread color from the set of thread colors, the thread color resulting from the second embroidery design.

15 Claims, 10 Drawing Sheets

Related U.S. Application Data continuation of application No. 12/353,928, filed on Jan. 14, 2009, now Pat. No. 8,170,708.

(60) Provisional application No. 61/020,941, filed on Jan. 14, 2008.

(56) References Cited

U.S. PATENT DOCUMENTS

| | | | | | |
|---|---|---|---|---|---|
| 5,740,057 | A | * | 4/1998 | Futamura | 700/138 |
| 5,751,583 | A | * | 5/1998 | Kyuno et al. | 700/137 |
| 5,765,496 | A | * | 6/1998 | Futamura | 112/475.19 |
| 5,794,553 | A | * | 8/1998 | Futamura | 112/102.5 |
| 5,880,963 | A | * | 3/1999 | Futamura | 700/138 |
| 5,896,269 | A | | 4/1999 | Autry | |
| 5,896,822 | A | * | 4/1999 | Futamura | 112/102.5 |
| 5,904,109 | A | | 5/1999 | Asano | |
| 5,954,004 | A | * | 9/1999 | Futamura | 112/102.5 |
| 5,960,726 | A | * | 10/1999 | Yamada | 112/102.5 |
| 5,974,992 | A | | 11/1999 | Asano | |
| 6,012,402 | A | * | 1/2000 | Sekine | 112/102.5 |
| 6,105,520 | A | | 8/2000 | Frazer et al. | |
| 6,324,441 | B1 | * | 11/2001 | Yamada | 700/138 |
| 6,407,745 | B1 | * | 6/2002 | Yamada et al. | 345/593 |
| 6,631,306 | B2 | | 10/2003 | Funahashi et al. | |
| 6,708,076 | B2 | | 3/2004 | Zhang et al. | |
| 6,729,255 | B2 | | 5/2004 | Ton et al. | |
| 6,980,877 | B1 | * | 12/2005 | Hagino et al. | 700/138 |
| 7,228,195 | B2 | | 6/2007 | Hagino | |
| 8,090,466 | B2 | * | 1/2012 | Yamada | 700/138 |
| 8,170,708 | B2 | | 5/2012 | Goldman et al. | |
| 2004/0210336 | A1 | | 10/2004 | Block et al. | |
| 2005/0188906 | A1 | | 9/2005 | Goto et al. | |
| 2006/0060115 | A1 | | 3/2006 | Hagino | |
| 2009/0020054 | A1 | | 1/2009 | Taguchi et al. | |
| 2010/0106283 | A1 | | 4/2010 | Harvill et al. | |
| 2010/0108754 | A1 | | 5/2010 | Kahn | |
| 2012/0203372 | A1 | | 8/2012 | Goldman et al. | |

OTHER PUBLICATIONS

International Searching Authority, "Written Opinion of the International Searching Authority," issued in connection with international application No. PCT/US2009/031017, mailed Apr. 7, 2009, 6 pages.

International Bureau, "International Preliminary Report on Patentability," issued in connection with international application serial No. PCT/US2009/031017, issued Jul. 20, 2010, 8 pages.

United States Patent and Trademark Office, "Notice of Allowance and Fee(s) Due", issued in connection with U.S. Appl. No. 13/446,739, mailed Apr. 18, 2013, 6 pages.

United States Patent and Trademark Office, "Non-Final Office Action", issued in connection with U.S. Appl. No. 13/446,739, mailed Dec. 28, 2012, 6 pages.

United States Patent and Trademark Office, "Notice of Allowance and Fee(s) Due", issued in connection with U.S. Appl. No. 12/353,928, mailed Dec. 16, 2011, 5 pages.

United States Patent and Trademark Office, "Non-Final Office Action", issued in connection with U.S. Appl. No. 12/353,928, mailed May 27, 2011, 17 pages.

European Patent Office, "Extended European Search Report," issued in connection with Application No. 09703028.2, May 28, 2014, 4 pages.

United States Patent and Trademark Office, "Non-Final Office Action", issued in connection with U.S. Appl. No. 13/961,633, mailed Oct. 10, 2013, 19 pages.

United States Patent and Trademark Office, "Notice of Allowance and Fee(s) Due", issued in connection with U.S. Appl. No. 13/961,633, mailed Mar. 7, 2014, 13 pages.

* cited by examiner

1

*Roll-back includes removal of the annotation, removal of reference in machine's queue and removal of any entries within the "necessary colors" set that were resultant from the design's original annotation 901 – Color Difference Computation
Given two input sets of colors, count the number of colors in the smaller set that do not appear in the larger set
(see examples below)

Example 902

COLOR INPUT SET 1: Red, Green, Blue, Black
COLOR INPUT SET 2: Green, Orange

Computed color difference = 1

Example 903

COLOR INPUT SET 1: Red, Green, Blue, Black
COLOR INPUT SET 2: Black

Computed color difference = 0

Example 904

COLOR INPUT SET 1: Red, Green, Blue, Black
COLOR INPUT SET 2: Black, Orange, Yellow, Pink, Tan Computed color difference = 3

Figure 9.

SYSTEMS, METHODS AND APPARATUS FOR EMBROIDERY THREAD COLOR MANAGEMENT

RELATED APPLICATION

This patent arises from a continuation of U.S. application Ser. No. 13/961,633, filed Aug. 7, 2013, which is a continuation of U.S. application Ser. No. 13/446,739, filed Apr. 13, 2012, which is a continuation of U.S. application Ser. No. 12/353,928, filed Jan. 14, 2009, now U.S. Pat. No. 8,170,708, and claims priority to U.S. Provisional Application Ser. No. 61/020,941, filed on Jan. 14, 2008. The entireties of U.S. application Ser. No. 13/961,633, U.S. application Ser. No. 13/446,739, U.S. application Ser. No. 12/353,928, and U.S. Provisional Application Ser. No. 61/020,941 are hereby incorporated by reference.

TECHNICAL FIELD

The present disclosure relates to the production of embroidery designs on embroidery sewing equipment and, more particularly, to managing the various colors of thread used to produce such designs.

BACKGROUND

Modern embroidery is commonly created on sewing equipment that pairs a sewing mechanism with a means for synchronously moving a textile beneath that sewing mechanism. More specifically, a textile is moved in forward, back, left, or right directions while the sewing mechanism embeds stitches of thread within that textile having locations dictated by the aforementioned movements. Thus, as the process progresses a pattern of stitching emerges that is designed to represent a particular image or graphic. Embroidered designs are quite common on a wide variety of garments or products such as baseball caps, sweaters, or golf shirts. Furthermore, these designs are often produced such that they contain a variety of different thread colors to best represent the aesthetics of the graphic being depicted. For example, an embroidery design depicting the image of a basketball might use orange thread stitching to depict the round circular area of the ball and then use smaller black thread stitching to depict the outline and other black lines that are present within the ball's image. Thus, two different thread colors, orange and black, are utilized to create embroidery representing the basketball design. As designs become more complex or sophisticated, designs may require an even greater number of different thread colors. In fact, many embroidery designs may require more than a dozen unique colors of thread to be produced, where each different part of the design is embroidered using a different thread color.

BRIEF DESCRIPTION OF THE DRAWINGS

FIG. 9: Describes and provides examples of computing color differences between sets of thread colors.

DESCRIPTION

Figure 1:
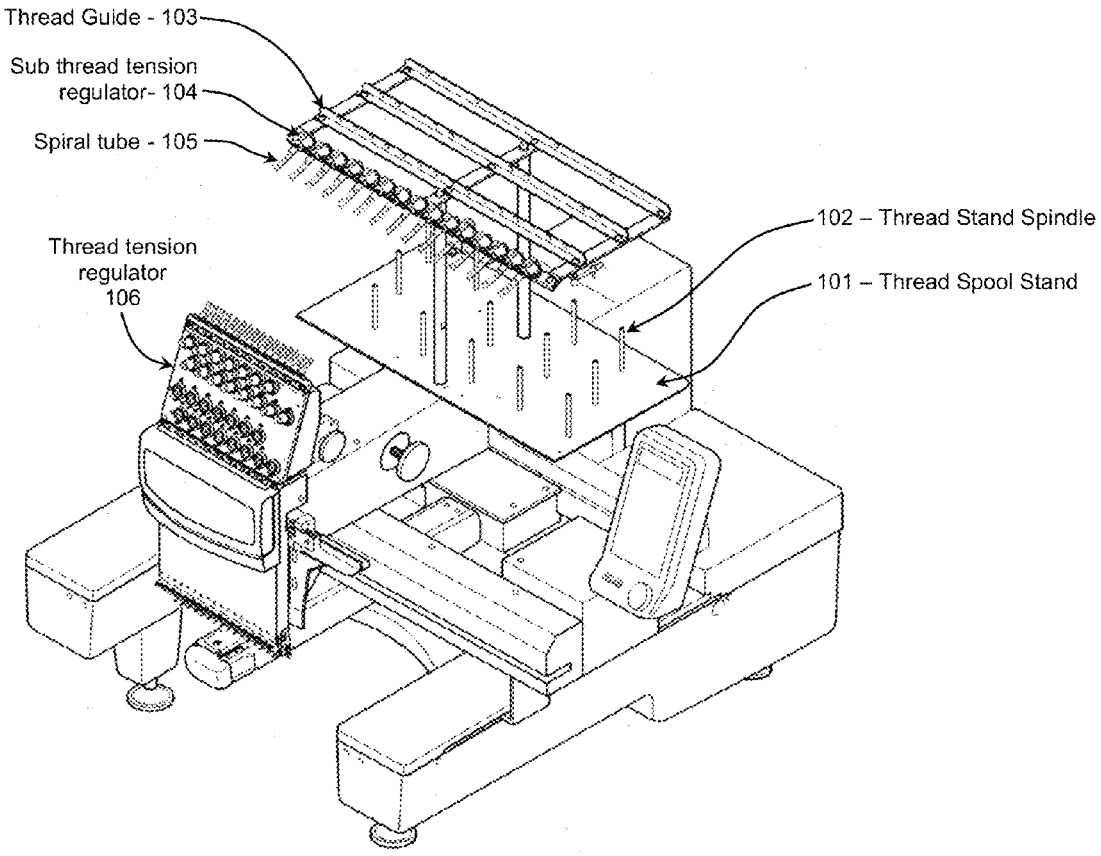
FIG. 1: Example of a single head embroidery machine showing components where spools of thread are held on spindle stand and spindles marked 101 & 102 respectively. Other parts are marked as points of reference.

Modern embroidery equipment exists to easily produce multiple thread color designs by allowing more than one thread color to be loaded onto the equipment at a single time. In fact, many machines allow 6 or more different spools of uniquely colored thread to be placed on the equipment allowing it to automatically transition to embroidering with a different thread color at varying times during the production of a design. However, it is impractical for such embroidery equipment to hold (or have loaded) an unlimited number of thread colors and modern embroidery equipment usually does not allow more than approximately 15 unique thread colors to be loaded at a single time. This instigates an issue where from a potentially infinite palette of colors, thread manufactures have created many hundreds of unique thread colors, no more than a very limited set of those colors can be loaded onto embroidery equipment at a single time (e.g. perhaps 15 thread colors at once). Subsequently, producing designs that use a larger number of thread colors than can be loaded onto equipment is significantly more difficult or impractical. Furthermore, if one embroidery design requires a specific subset of thread colors to be loaded onto the machine, a different embroidery design may require a different subset of thread colors. While those two subsets of thread colors may overlap (i.e., both subsets may contain a black thread color for example), the differences in the subsets will require certain spools of thread to be removed from the equipment so that new spools of different colors may be loaded such that the different embroidery design may be produced.

Within many typical manufacturing environments the subset of thread colors loaded onto embroidery equipment is constantly changing to meet the requirements of the specific embroidery designs being produced. For example, if an embroidery machine can only hold two different thread colors at once and is producing a basketball design that uses orange and black colored thread, if the next design is one of a baseball design requiring white and red colored thread, both the black and orange colored threads must be removed from the machine and replaced with white and red colored threads before that baseball design may be produced.

The replacement of a thread color currently loaded onto a machine with a different new thread color is typically a manual process whereby a machine operator (i.e., a person in charge of running the equipment) must remove a spool of thread currently sitting within a holder and threaded into the mechanics of the equipment and then put a new spool of thread in its place such that it then feeds into those same mechanics. There are a variety of techniques that may be employed to facilitate this change including tying off the end of the new thread to a remnant of the old thread still contained within the mechanics of machine such that the new thread may be manually pulled through the mechanics using the old thread remnant. Regardless of the specific technique, it is a manual process involving human intervention and time. As such, human error and efficiency can become significant factors throughout this process. One such error that may occur is when the machine operator replaces a thread spool with one of an incorrect color. The machines themselves typically have no mechanism to detect what color thread has been loaded onto them. Thus, if an operator were to mistakenly load red thread onto a machine instead of black thread, for example, the embroidery design would contain red stitching where there should be black leading to output which is substantially flawed. Another drawback of human intervention is that a machine may actually need to sit idle while thread colors are changed, thereby reducing the overall efficiency of the production environment.

Figure 2:
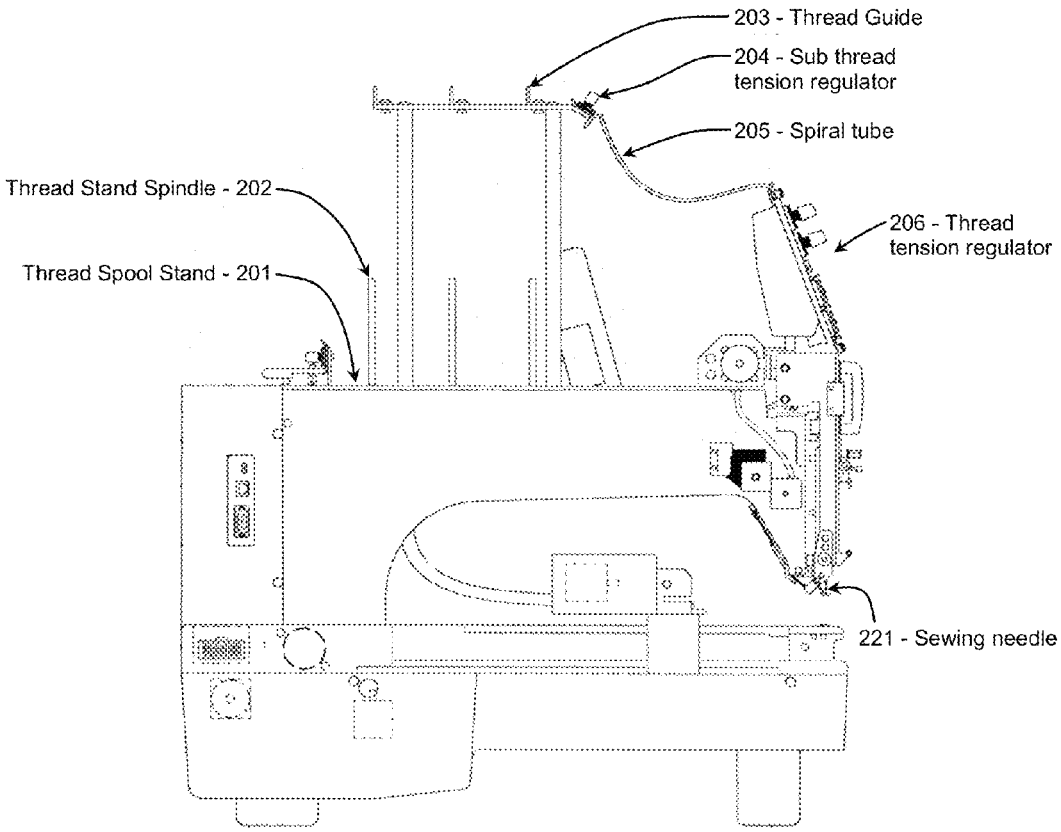
FIG. 2: Side view of example single head embroidery machine with components labeled as in FIG. 1.

Described here are methods and systems designed to improve the efficiency with which thread colors are managed while also reducing the possibility of human error. The preferred embodiment employs a combination of both hardware and software based methods to achieve these goals and the description that follows begins by explaining the hardware and mechanical attributes. Referring to FIG. 1, an embroidery machine typically holds spools of thread using some organization of spindles (FIG. 1, parts 101 & 102). FIG. 2 shows a side view of the same machine where one can more easily see how a spool of thread is placed on a thread stand spindle 202. Once on the spindle, the thread travels through thread guide(s) 203, a sub thread regulator 204, a spiral tube 205, a thread tension regulator 206, and through other parts of the machine until ultimately it is threaded through the eye of the sewing needle, which enables the thread to penetrate the product being embroidered. The specific path that thread takes after being pulled off of the spool by the mechanics of the machine is not significantly relevant to the methods, systems, or apparatus presented here, but does provide a general context for the specification.

Figure 3:
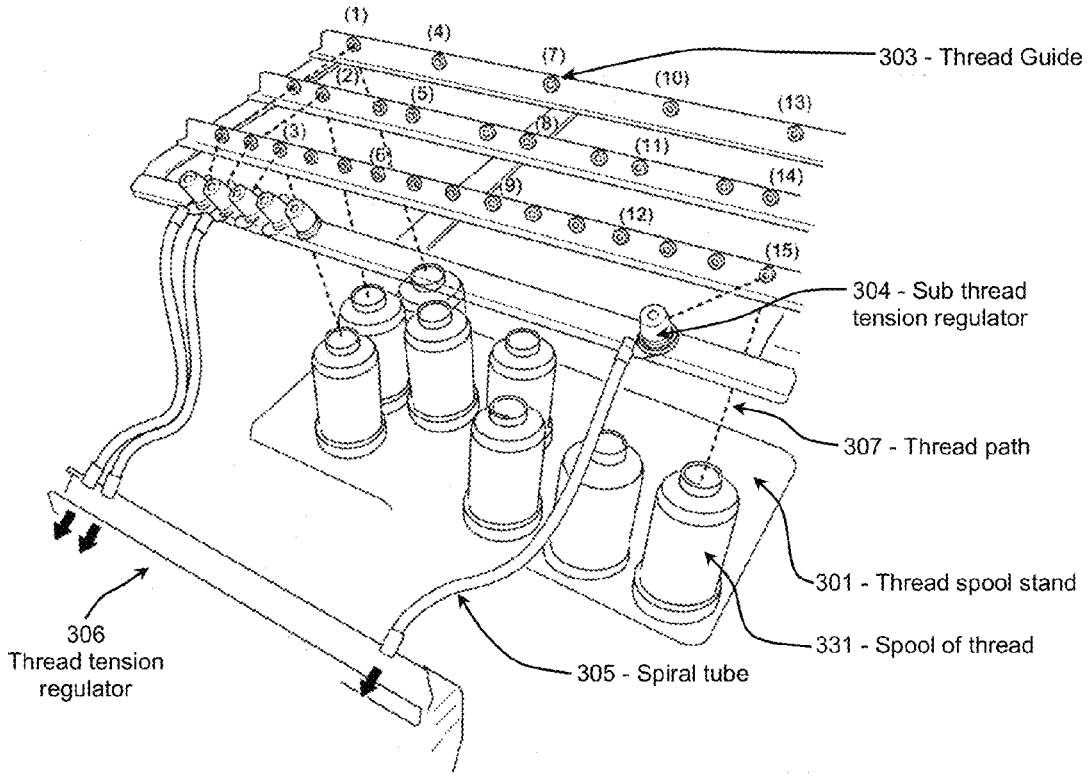
FIG. 3: Enlarged view of the upper thread stand and area where spools of thread are depicted as sitting on top of the thread stand spindles. Certain elements such as some of the spiral tubes, thread stand spindles, etc. are not depicted to allow a better view of components that would otherwise be obscured. In this example, although the thread stand is capable of holding 15 spools of thread, only 8 spools are shown. The numbers in parenthesis indicate the thread guide holes for which each spool's thread should initially travel (e.g. the first spool 1 travels through hole 1, etc.).

The methods and apparatus presented here involve the area of an embroidery machine that holds the spools of thread. FIG. 3 provides a closer view of this area of the example machine illustrated in FIGS. 1 and 2. As shown, spools of thread 331 are placed on the thread spool stand over the spindles discussed previously. Examples of where thread flows from these spools is indicated by the dotted line thread paths 307. Each spool typically contains a different color of thread. The example machine depicted here is capable of holding up to 15 spools whose thread eventually becomes threaded through 15 needles within another part of the machine. The needle number that thread is ultimately threaded through is commonly referred to as that thread color 'position' on the machine. For example, red thread may be placed on needle one while blue thread might be placed on needle seven. Here, the needle number also indicates the spindle on which the related thread spool is placed. In FIG. 3, the spool in the furthest back left position relates to needle 1 where its thread flows through the hole labeled (1) within the thread guide. Subsequent holes are labeled (2) through (15) and lie overhead the location where a spindle and spool of thread may be placed. Hence, a direct correlation between needle numbers and numbers that may be assigned to thread spool spindles may be easily made.

Knowing what thread color is associated with which needle position is important information when considering how an embroidery design is to be produced. Specifically, the machine needs to know which needle to switch to at a given point during production to ensure use of the proper thread color at that point. If an embroidery design requires many different thread colors, the machine will have to switch to many different needle positions during the design's production. As noted previously, specifying which needles to switch to during production (or alternatively specifying which needle positions contain which colors) has typically been a manual process where a human operator typically enters this information via computer or keypads located near the equipment. This human intervention can be substantially eliminated by enabling the embroidery machine to automatically detect what thread colors corresponded to different needle positions (i.e., different thread spool spindles). As described in greater detail below, this can be accomplished by placing sensors around the thread spool spindles to allow thread spools to be automatically identified as they are placed on the machine.

Figure 4:
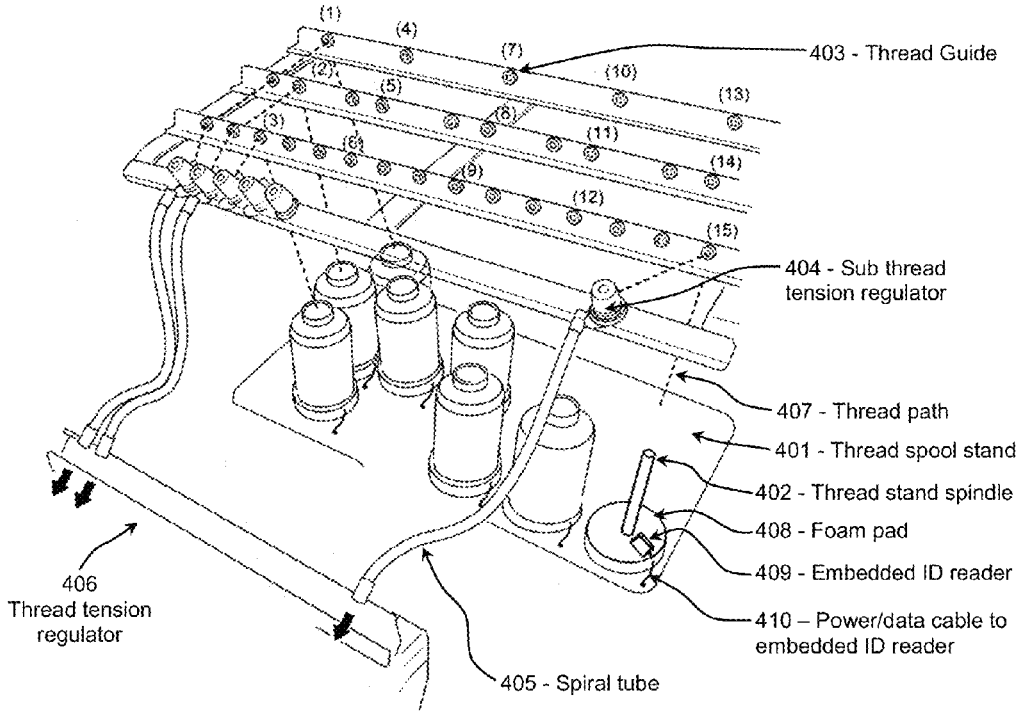
FIG. 4: Diagram of FIG. 3 shown as it would appear with the right most spool of thread removed and with multiple ID readers installed (see embedded ID reader 409 and power/data cables 410).

Specifically in one example described herein, small radio frequency identifier (RFID) readers are embedded in a circular foam base that sits beneath each thread spool spindle. Referring to FIG. 4, the foam pad 408 is seen with a small embedded ID reader 409 which is connected via power/data cable 410 through a hole in the foam. This cable may then easily travel through a small hole in the thread spool stand to allow its connection to a microcontroller or other interface easily mountable on the underside of the thread spool stand. Furthermore, each of the 15 thread stand spindles will have this same assembly installed beneath it in similar fashion. Thus, in this case, 15 short range RFID readers are installed corresponding to the 15 thread stand spindles. Their connection to a microcontroller or other interface enables the detection of radio frequency tags within the proximity of those readers. Specifically, an RFID tag (e.g. in the form of a small sticker) can be placed on the inside of each spool of thread that might be placed on the machine. The tag, when in the vicinity of the RFID reader, will transmit a unique identifying number to the reader that is received by a microcontroller or other interface and subsequently matched against a known list of identifying numbers to ascertain exactly which spool of thread is within the proximity of the RFID reader at a particular thread stand spindle. Of course, this presumes that thread spools have had these RFID tags previously affixed to them and that information has been recorded that relates the identifying number emitted by each tag with the particular spool's thread color to which it has been affixed. Furthermore, when the microcontroller or other interface receives unique identifying numbers, it accesses this information so that the thread color of the spool of thread placed on the spindle may be deduced.

Figure 5:
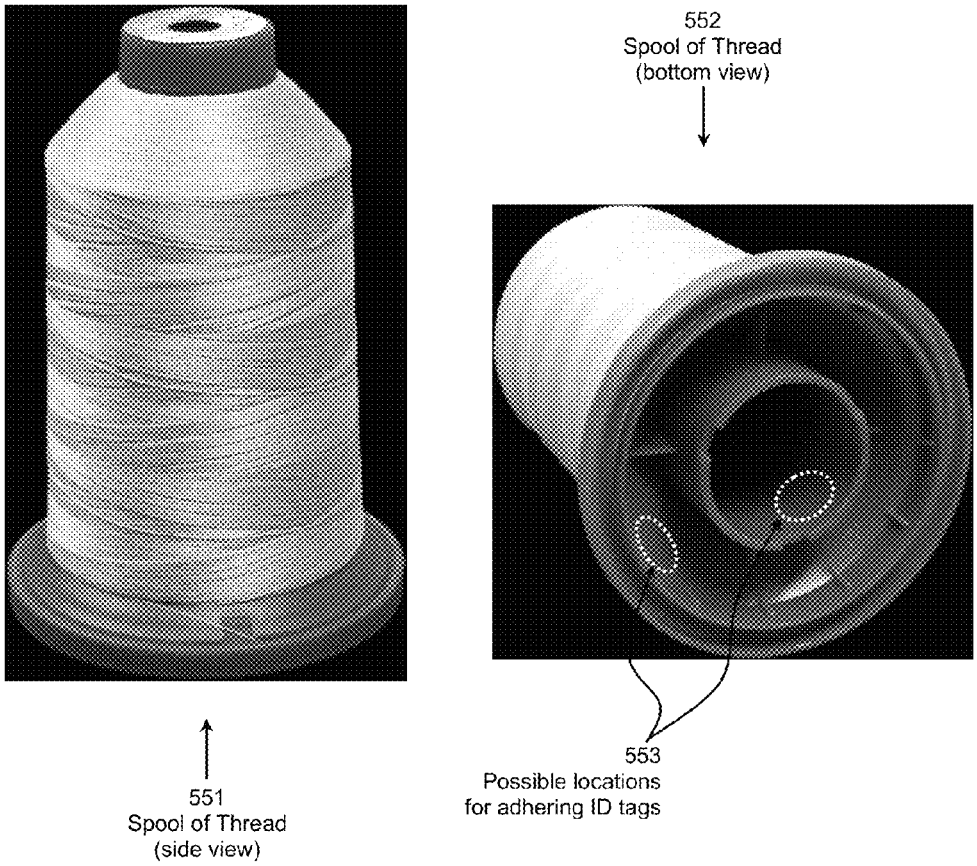
FIG. 5: Depicts appearance and construction of a typical spool of thread from side and bottom view perspectives.

FIG. 5 shows the appearance and construction of a typical spool of thread from side and bottom view perspectives. The thread, which often may be composed of either natural or man-made fibers, is wound around a cone-like construct typically made of some type of molded plastic. Hence, every spool of thread has two primary parts: the actual thread as well as the plastic construct around which it is wrapped. When viewed from the bottom, many hollow areas may be seen within this plastic construct including the long tube-like void at its center that allows it to be placed on a thread stand spindle. It is underneath the spool, typically within one of these hollow areas, where it is easiest to place a uniquely identifying tag, in this case, a small round shaped sticker constructed of thin PVC (polyvinylchloride). Once tags are place on the thread spools, for example, after having procured them from a thread manufacturer or distributor, each spool may be individually placed near a sensor that detects the tags identifying number and allows a user to correlate that number with the color of thread that is on the spool. These correlations are most easily stored within an electronic database after which all of the thread spools may be stored as general inventory for the manufacturing facility. When the spools are pulled from inventory and placed on an embroidery machine, the previously affixed tags enable the machine (with the modifications previously described) to deduce or determine and transmit what color thread is present on specific spindles or needles of the machine. This information subsequently allows appropriate needle position movement instructions to be sent to a machine automatically without human involvement so that related embroidery designs are produced using the correct combination of thread colors.

An embroidery design to be produced on an embroidery machine typically exists as an embroidery data file that is transmitted to the machine prior to its production. This data file typically stores a sequence of two-dimensional Cartesian coordinates (specified as pairs of x,y values) that indicate the sequence and location of needle penetration points (i.e., stitches) within the design. Also, because embroidery designs often consist of more than a single thread color, this data file usually has what are referred to as color change commands intermingled within the sequence of coordinates that indicate the precise moment in the stitching sequence when the thread color should change. Another type of useful information commonly stored within the embroidery data file is the specific sequence of thread colors that should be used to create the design. These thread colors may be represented within the file in a variety of different ways including but not limited to their related red, green, and blue color value components or specific thread manufacturer's model numbers. Regardless, the specified color sequence combined with the presence of color change commands within the sequence of coordinate positions is enough information to determine which needles or thread colors should be transitioned to at which specific points during the embroidery design's production provided that it is known which spindle or needle positions contain the specified thread colors. Thus, this again illustrates the usefulness of the system which automatically detects the thread colors placed on individual spindles versus requiring human intervention to manually specify a correlation.

Figure 6:
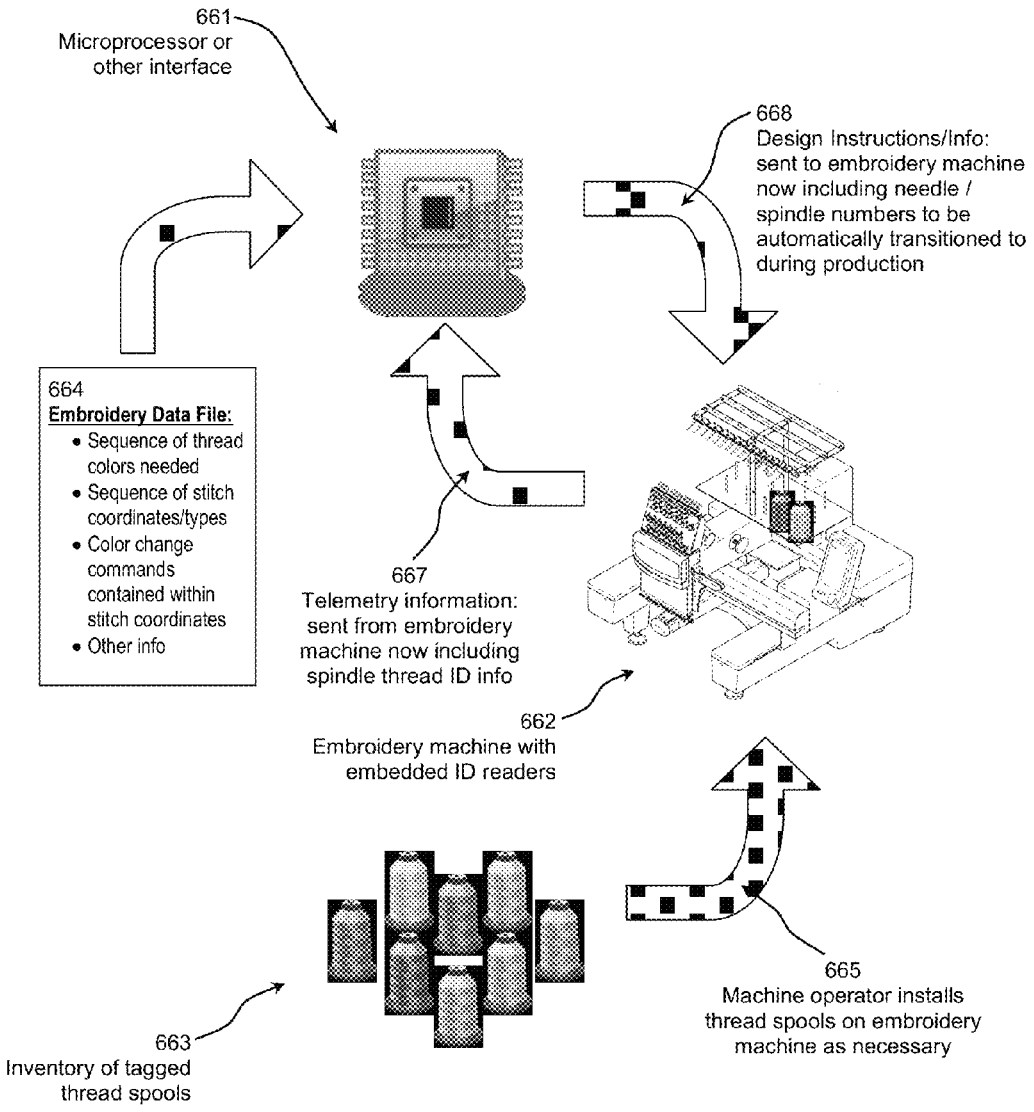
FIG. 6: Summarizes the flow of information and some of the physical processes that occur during use of the thread spool sensing system.

FIG. 6 summarizes the flow of information and physical processes that occur during use of the thread spool sensing system. Note that microprocessor or other interface 661 represents the example hardware and software systems that may be used to act upon the digital signals that are transmitted or received here. This item 661 may typically exist in the form of a dedicated microcontroller, a general purpose Personal Computer, or a combination of two or more such devices. However, any other device capable of accepting and generating digital signals as specified via basic software instructions could be used to implement the example methods and apparatus described herein.

FIG. 6 also refers to telemetry information 667 which is data transmitted by an embroidery machine that indicates various aspects of its current state of operation. Typically, embroidery machines are capable of digitally transmitting a wide variety of data for use or monitoring at another location (for example, on the screen of a nearby personal computer). This data may include things like the number of stitches that remain to be sewn within the embroidery design currently being produced or if a sensor has detected that a thread break has occurred. In addition to these types of data, the machine may now also transmit the ID numbers of thread spools that have been placed on the machine and when a thread spool is changed (i.e., the operator replaces a thread color spool with a new one), the machine can provide notification of such changes as part of the telemetry data being continuously transmitted.

Another method developed considers that a manufacturing environment may consist of one or more embroidery machines producing a continuous stream of varied embroidery designs where the thread color requirements may be different for each design. Here, computer-implemented methods are developed to optimize such production by scheduling embroidery designs to be produced on specific machines in specific orders such that the amount of time and human intervention required to manage thread colors (e.g. replacing thread spools with other spools of different colors, etc.) is reduced. In developing such methods, there are two dominant factors considered. First, given a sequence of embroidery designs to be produced, the thread colors required by each design can be evaluated and compared to the thread colors required by the other designs. More specifically, an arbitrary ordering of embroidery designs to be produced on a particular machine may be generated. Then, the number of times any thread spool is required to be replaced (i.e., due to a design needing a different thread color that is currently not present on any spindle of the machine) is counted. This count, referred to as the spool change count, consists of the total number of replacements that would have occurred during the production of all embroidery designs in the sequence. It should be noted that if the embroidery designs where produced in a different sequence, a different spool change count could result. For example, producing all the designs whose thread colors are already present on one or more of the spindles of the machine first, before producing designs requiring different thread colors could ultimately lead to a much lower spool change count. Thus, all possible orderings of a particular set of embroidery designs could be generated where the spool change count is computed for each ordering. If the ordering chosen for actual production of the design is the one whose spool change count was lowest, this indicates fewer spools of thread will need to be changed which yields a potential reduction in the amount human operator time/labor required to change thread spools. It may also be useful to consider other metrics other than the total spool change count, to evaluate the optimality of a chosen ordering of embroidery designs. These other metrics may include the minimum, maximum, and average number of thread spools that must be changed between the productions of each embroidery design in the sequence. Incorporating the evaluation and reduction of such statistics further ensures that any significant delay between the productions of individual embroidery designs is reduced.

The second major factor to consider is that in a production environment with multiple embroidery machines, different machines may have different sets of thread colors currently loaded onto their spindles. Hence if within the set of embroidery designs to be produced, one can schedule designs to be produced on machines that already contain all (or a majority of) the thread colors needed by those designs versus scheduling them on machines that do not have all or a majority of the thread colors needed, the spool change count for the individual machines may be reduced further. Here again, all combinations of running a given set of designs on the given set of machines can be determined where the resultant minimum spool change count may then be computed as described previously for each machine. Then, the combination (i.e., a production schedule) that yields the lowest total spool change count (i.e., the spool change count when the counts for all machines are summed together), may be chosen to yield a reduction in the amount of time spent changing thread spools. Additionally, the reduction of other statistics as previously mentioned, may also be used to choose the preferred combination.

A competing factor to consider when scheduling designs to be produced among multiple embroidery machines is a situation that may occur when disproportionate amounts of production are scheduled to occur on a particular machine or subset of machines. In this case, other machines may be left dormant or running at less than their full operating capacity in terms of producing embroidery designs. Thus, even though a particular production schedule may significantly reduce the amount of time needed to change thread spools, it may increase the amount of time needed to actually produce the set of embroidery designs since all of the machines are not being fully utilized. This, in turn also can increase labor costs because a human operator typically must be present to monitor the equipment until production completes and it also has the undesirable consequence of reducing the overall throughput of the manufacturing environment. Hence, it is important to balance the need to have evenly utilized embroidery machines with the goal of reducing overall thread spool change counts.

Evenly utilizing embroidery machines in a production environment means maintaining that each machine always has an embroidery design to produce and that machines are not sitting dormant (i.e., not producing embroidery designs) while other machines have a backlog of designs waiting to be produced. Utilization can be largely predicted by understanding how much time it takes to produce a particular design on an embroidery machine. More specifically, the production time needed to produce any particular design on an embroidery machine may be approximated by factors that include the number of stitches in the design and the speed at which stitches are produced on the machine, as well as the number of trims, needle changes, jumps or other more singular events that are specified to occur during the design's production and typically require fixed or predictable time periods. For example, the amount of time required to perform a thread trim may be 5 seconds, whereas if 3 thread trims will occur during a design's production, this will effectively add an additional 15 seconds of production time. In general, a design's production time may be accurately predicted prior to it actually being produced on an embroidery machine.

Other, less significant factors that may affect the amount of time required to change thread spools or otherwise manage thread color on equipment include: the location at which a spool of thread currently resides on a machine, the likelihood that a thread color being removed will be needed again for subsequent designs in the near future (beyond the current sequence/schedule of designs), etc. These factors may also be considered when developing optimal methods for scheduling the production of a set of embroidery designs. For example, when a thread spool must be removed from a machine, it may often be feasible to do so while the machine is actually running (i.e., during the production of an embroidery design) such that the machine does not actually have to sit idle during the thread spool change process. However, when doing this, it is often easier and faster when the corresponding needle for which the thread color is being changed is not adjacent or near a needle that is currently sewing (e.g., moving up and down) on the machine. The nearby moving needle makes it more difficult for the operator to thread the new color and also increases the likelihood of bodily harm during the process. Hence, adjusting the sequence of embroidery designs to be produced can be done with a preference such that needle colors that must be changed do not lie close to needles that would be necessary or active in producing immediately preceding designs. Thus, the operator may change the thread colors on such needles while the machine is still producing one or more preceding designs. In general, a computer-implemented method can be further devised that instructs the machine operator when to change thread spools based on these factor after a preferred ordering or scheduling of the designs has been computed. This instruction of the operator may also be further based on whether or not a color to be removed from the machine would be necessary for any still yet unproduced parts of an embroidery design currently being generated or the likelihood of it being needed for future designs.

The preferred embodiment for developing a production scheduling or ordering of embroidery designs on a set of one or more embroidery machines relies on the concept of clustering. The general concept is focused on means by which similar items within a data set may be grouped or clustered together, where similarity may often be defined differently depending on the types of items contained within such a data set. This concept is applied here where data set items are references to specific embroidery designs to be produced and similarity between designs is measured by how similar their thread colors are (i.e., if they share a minimal subset of necessary thread colors they are considered more similar). FIG. 9 illustrates how one such similarity metric (referred to as color difference) may be computed. Once a similarity metric is chosen (sometimes referred to as a difference metric) a matrix may be formed that computes the similarity or difference between all pairs of items within the data set. Standard clustering algorithms may then be employed to group similar items together. Causing designs that are similar in color to be scheduled to run on the same embroidery machine should result in a grouping that necessitates fewer thread spool changes because all designs in the group are very similar in color.

Figure 7:
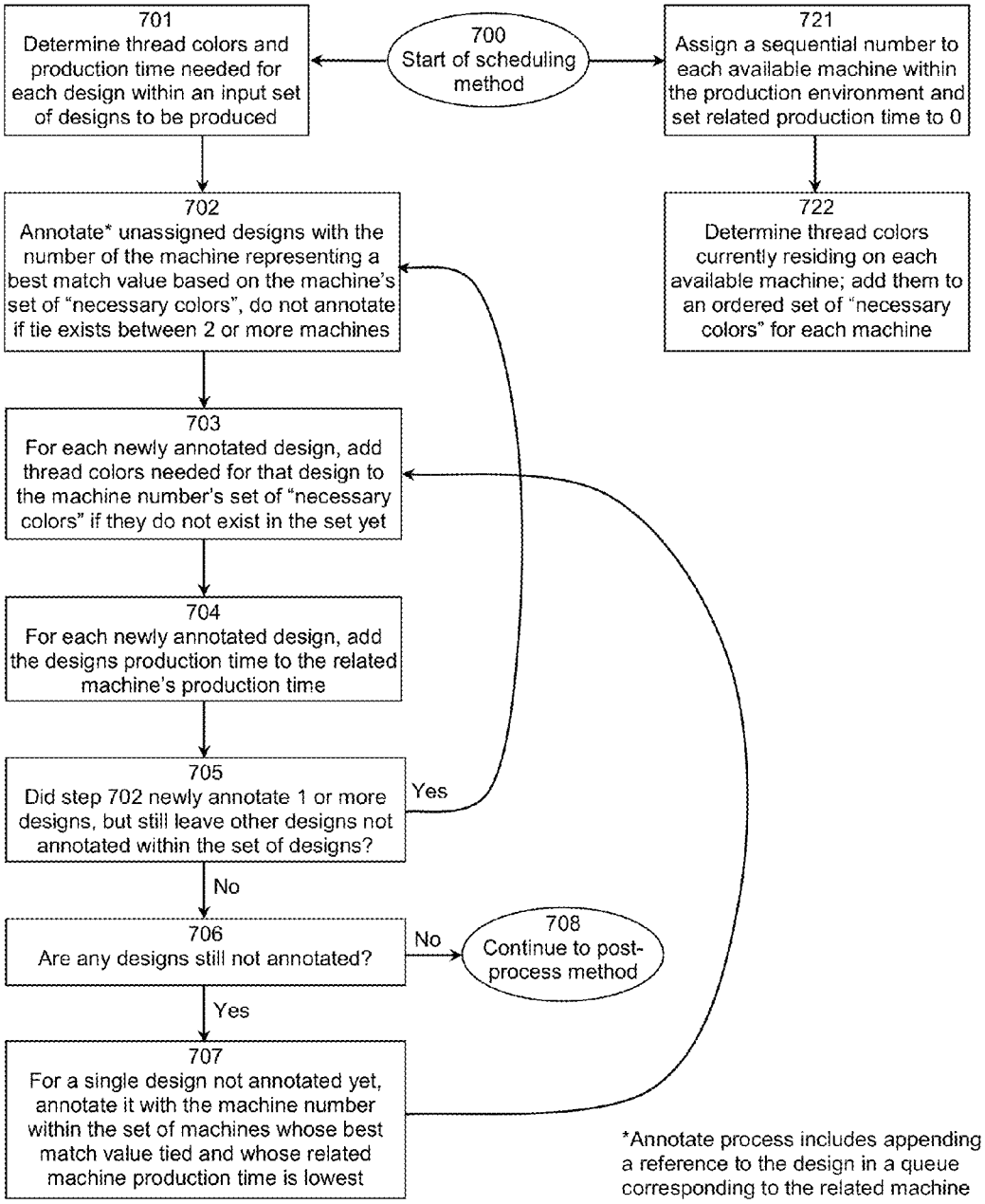
FIG. 7: Depicts a process for scheduling embroidery designs for production on a set of embroidery machines.
Figure 8:
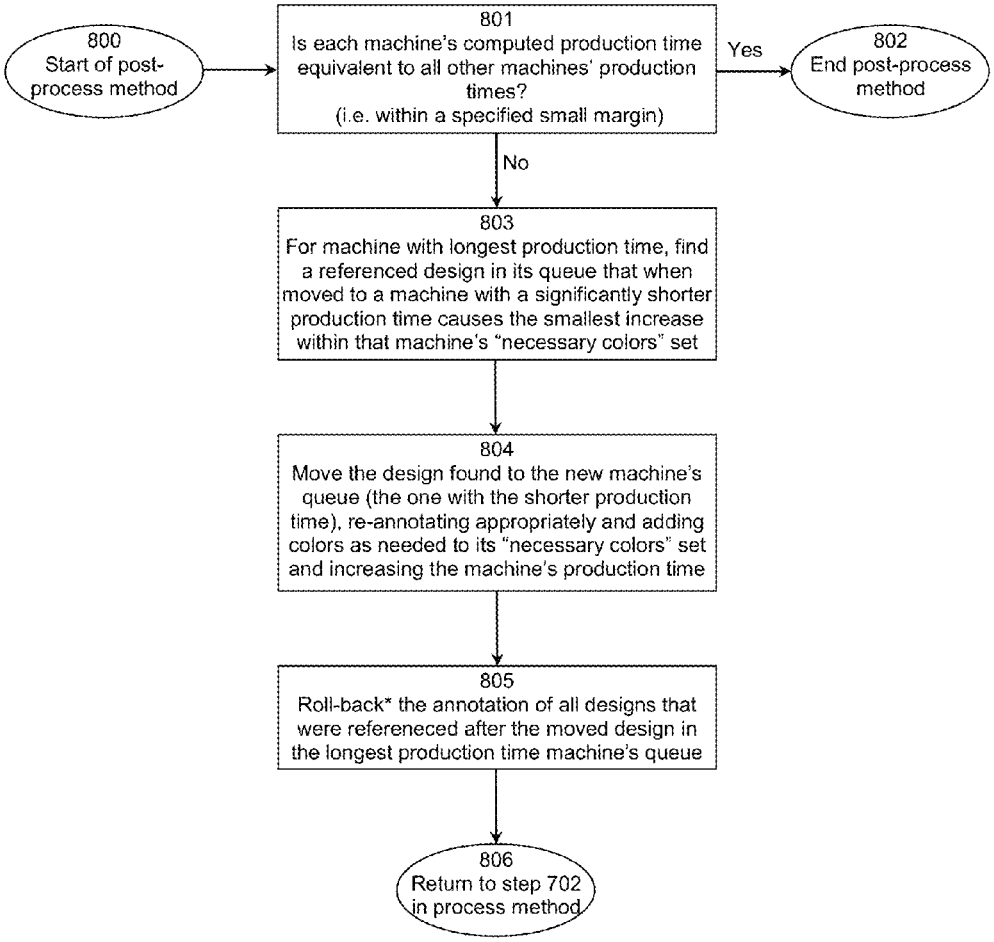
FIG. 8: Depicts post processing steps utilized in the context of the process illustrated in FIG. 7.

FIGS. 7 and 8 describe a computer-implemented method by which designs may be scheduled (i.e., clustered) on a set of embroidery machines balanced against the factor of maintaining high utilization of all available equipment as described previously. Initialization of computer-implemented data structures begins in blocks 701 and 721. Specifically, for each design to be scheduled, the number of unique thread colors required by that design as well as its estimated production time is computed and stored (i.e., block 701). Additionally, for each machine within a set of machines for which production should be scheduled, a unique sequential number is assigned to identify the machine and a production time of zero is specified to indicate that no designs have been scheduled on the machine yet; hence the machine is currently estimated to be spending 0 time producing designs. Block 722 then determines the thread spool colors that are currently residing on each machine and adds them to an ordered set of "necessary colors" for each machine. This set of "necessary colors" indicates the thread colors currently made available to the machine to produce embroidery designs (and not necessarily just the colors that are currently residing on the machine). The ordered set of "necessary colors" corresponding to each machine may change (e.g. increase or decrease) as the computer-implemented method is executed.

After block 701, all designs are initially considered to be unscheduled which means that they have not yet been assigned to any particular machine for production. Block 702 may annotate one or more designs such that they become scheduled to run on a particular machine within the set of available embroidery machines. Annotation effectively involves marking a reference to the design with the unique number that was assigned to the machine (in Step 721) on which the design is scheduled to be produced. The annotation process also includes appending a reference to the design in a computer-implemented queue data structure that corresponds to the related embroidery machine. Block 702 first annotates designs that best match a machine's "necessary color" set which means the color difference (as defined in FIG. 9) between an embroidery design's set of unique colors and a particular machine's "necessary color" set is the lowest of all designs that could be scheduled on any particular machine. If a single design's color difference is identical when computed relative to two or more different embroidery machines (i.e., a tie exists in the best match values computed), the design is not annotated in this step.

For each design annotated, block 703 contributes any unique thread colors required by the design to the ordered set of "necessary colors" corresponding to the machine on which it was scheduled, if such colors are not already contained within the set. Additionally, block 704 adds each annotated design's estimated production time to the related machine's production time on which it has been scheduled. When designs are annotated, block 703 may effectively increase the number of items in the "necessary colors" set maintained for each machine and potentially affect best match values computed for still unassigned/un-annotated designs. Thus, if any designs were newly annotated causing a change in related machines' "necessary colors" sets, block 705 will trigger a return to block 702 of the method such that unassigned designs may attempt to be annotated based upon those machines' updated "necessary colors" sets. If no designs were newly annotated (i.e., no increases in "necessary colors" sets were realized), block 705 allows continuation to block 706, which checks if there are any designs that have still not been annotated yet. If all designs have been annotated, block 708 is executed which subsequently continues to the post-process method described in FIG. 8. Alternatively, if some designs are still not annotated yet, each unassigned/non-annotated design could be matched to one of several machines within the set of available machines since an identical best match value was computed for each such machine. Thus, block 707 picks one such unassigned design, and annotates it with the machine number within the set of machines whose best match values were identical and whose related production time is the shortest. This has a desirable benefit of giving a preference to scheduling designs on under-utilized machines when an equally good choice may be made in terms of thread color management constraints. After annotating a design in block 707 which potentially affects a set of "necessary colors" for the related machine, the method returns to block 703.

FIG. 8 illustrates the post process method referenced previously in the overall scheduling method and within FIG. 7. This method is invoked after all designs have been scheduled to occur on one or more machines within the total set of available machines. The method is used to make load-balancing adjustments such that designs scheduled to be produced on one machine may be ultimately shifted to instead occur on a different machine, such that each machine's production time is relatively equal and all machines are well utilized. To determine if such adjustments are even necessary, block 801 first compares machines' relative estimated production times to see if they are approximately equivalent (i.e., each machine would be running for approximately the same amount of time—within a specified margin). If so, the method will complete its execution as indicated in block 802. Otherwise, block 803 evaluates all designs within the queue associated with the machine whose estimated production time is longest. More specifically, block 803 finds a referenced design that when moved to a machine with a significantly shorter production time (i.e., re-annotated and scheduled to occur there) causes the smallest increase within that different machine's "necessary colors" set. Note that this is synonymous with the color difference between the design's color set and the "necessary colors" set for the related machine being comparatively minimal. Once such a design is found, block 804 moves the reference to the design to the new machine's queue (the one with the shorter production time), re-annotating the design appropriately and adding colors to that machine's "necessary colors" set as needed as well as increasing that machine's production time by an amount equal to the estimated production time for the design. Block 805 then rolls-back the annotation of all designs that were referenced after the moved design in the longest production time machine's queue. Here, the roll back process for each design includes removal of the annotation (i.e., machine assignment), removal of the reference to the design in the machine's related queue, and removal of any entries within the "necessary colors" set that were resultant from the design's original annotation. After the roll-back step, the method returns to block 702 (as indicated in block 806) because there may now exist non-annotated designs within the input set of designs to be scheduled, that must be re-processed.

After the clustering methods described previously (and illustrated in FIGS. 7 and 8) complete, machines will each have corresponding queues that contain references to the embroidery designs that have been slated for production on them. At this point, a machine's queue contains such embroidery designs in the order in which the previously described clustering method placed them there. However, as discussed before, even the ordering in which a set of designs are scheduled to run on a single machine can have a significant impact on the spool change count or other factors relative to the cost of managing thread colors on that machine. Since the current orderings resultant from the clustering methods' application may not be optimal, a re-sequence process is now performed that is intended to address such issues.

Figure 10:
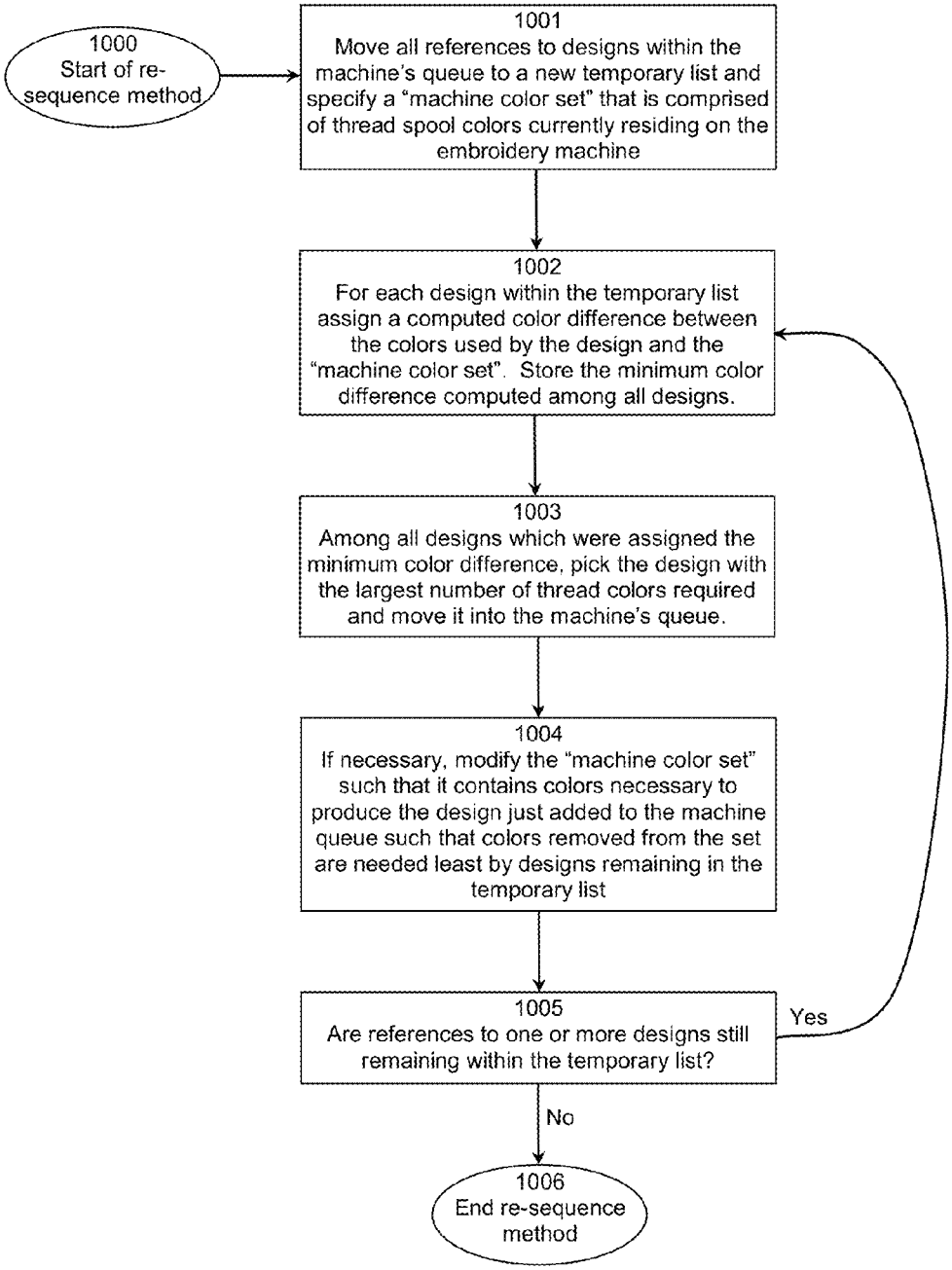
FIG. 10: Depicts a process of re-sequencing embroidery designs which have been scheduled to occur on an embroidery machine.

FIG. 10 illustrates a computer-implemented re-sequence process which adjusts the order that designs are scheduled to be produced on a particular machine. This re-sequence process is executed for each machine referencing two or more designs within its related queue. The process begins with block 1001, which moves all references to embroidery designs within the machine's queue to a new temporary list. Hence, the machine's queue is then empty with all references to the designs now residing within the temporary list. Additionally, block 1001 specifies an initial "machine color set," which is a set of unique thread colors where the number of colors in the set is a constant number equivalent to the number of thread spindles (or needles) present on the related embroidery machine. This set of colors is initially specified to contain the thread spool colors currently residing on the embroidery machine. This "machine color set" will potentially be modified during the course of the re-sequence method.

Block 1002 computes and assigns a color difference value (using the method illustrated in FIG. 9) for each design referenced within the temporary list and the colors contained within the "machine color set." The block also records the minimum color difference computed among all designs referenced within the temporary list. Block 1003 then chooses a design, among all designs that were assigned that minimum color difference within the temporary list that requires the greatest number of unique thread colors. For example, if design A uses colors red, blue and green, and design B uses just yellow and blue, but both designs have a minimum color difference of 0, design A is chosen because it contains 3 colors versus the 2 colors contained within design B. Ultimately, the chosen design is then moved out of the temporary list and back into the machine's queue of scheduled designs at the end of block 1003.

If the design chosen in block 1003 had a minimum color difference greater than 0, this is an indication that not all colors required by the design were contained within the "machine color set". Thus, block 1004 modifies the machine color set such that it contains all of the colors necessary to produce the chosen design. The modification here may require that one or more thread colors contained within the "machine color set" are removed such that an equal number of new thread colors may be added. For example, if the color difference value was equal to 1, this indicates that one existing color in the "machine color set" must be removed so that one new color may be added. The choice of what color should be removed is based on which existent color in the set is used the least among the designs remaining in the temporary list. For example, a color that is used by only one design within the temporary list would be removed before a color that is used by two designs within that list.

The re-sequence method then repeats and continues to execute until all designs within the temporary list have been removed and added to the machine's queue as indicated by block 1005. The fact that the method favors designs with greater numbers of colors for earlier scheduling on the machine is a useful heuristic that in most practical circumstances helps further reduce thread spool change requirements during production. The use of such heuristics is beneficial particularly when the original number of designs referenced is large enough that the computational requirements of testing all possible orderings of embroidery designs (as discussed previously) becomes less feasible. Furthermore, the use of the color sensing apparatus described where the placement of colored thread spools on a machine's spindles are automatically detected and tracked, further facilitates many of the methods elaborated upon here and helps provide a comprehensive solution to managing embroidery thread colors in both large and small embroidery production environments.

What is claimed is:

1. A method, comprising:

determining a set of thread colors needed for a set of embroidery designs including a first embroidery design and a second embroidery design;

annotating the second embroidery design, the annotation comprising appending a reference to the second embroidery design in a first queue of designs to be embroidered by a first embroidery machine; and rolling back the annotation of the second embroidery design, the rolling back comprising:

removing the reference; and removing a thread color from the set of thread colors, the thread color resulting from the second embroidery design.

2. A method as defined in claim 1, further comprising moving the first embroidery design from the first queue of designs to be embroidered by the first embroidery machine to a second queue of designs to be embroidered by a second embroidery machine, the rolling back being performed in response to the moving.

3. A method as defined in claim 2, further comprising re-annotating the second embroidery design.

4. A method as defined in claim 2, further comprising determining whether a first production time associated with the first embroidery machine is longer than a second production time associated with the second embroidery machine by at least a threshold amount, the moving the first embroidery design being in response to determining that the first production time is longer than a second production time by at least the threshold amount.

5. A method as defined in claim 1, wherein the second embroidery design is referenced after the first embroidery design in the first queue.

6. A system, comprising:

a first embroidery machine to embroider first designs;

a second embroidery machine to embroider second designs; and a computer to:

determine a set of thread colors needed for a set of embroidery designs including a first embroidery design and a second embroidery design;

annotate the second embroidery design, the annotation comprising appending a reference to the second embroidery design in a first queue of designs to be embroidered by the first embroidery machine; and roll back the annotation of the second embroidery design, the rolling back comprising:

removing the reference; and removing a thread color from the set of thread colors, the thread color resulting from the second embroidery design.

7. A system as defined in claim 6, whether the computer is further to move the first embroidery design from the first queue of designs to be embroidered by the first embroidery machine to a second queue of designs to be embroidered by the second embroidery machine, the computer to perform the rolling back in response to the moving.

8. A system as defined in claim 7, wherein the computer is further to re-annotate the second embroidery design.

9. A system as defined in claim 7, wherein the computer is further to determine whether a first production time associated with the first embroidery machine is longer than a second production time associated with the second embroidery machine by at least a threshold amount, the moving the first embroidery design being in response to determining that the first production time is longer than a second production time by at least the threshold amount.

10. A system as defined in claim 6, wherein the second embroidery design is referenced after the first embroidery design in the first queue.

11. A processor platform, comprising a microprocessor programmed to:

determine a set of thread colors needed for a set of embroidery designs including a first embroidery design and a second embroidery design;

annotate the second embroidery design, the annotation comprising appending a reference to the second embroidery design in a first queue of designs to be embroidered by a first embroidery machine; and roll back the annotation of the second embroidery design, the rolling back comprising:

removing the reference; and removing a thread color from the set of thread colors, the thread color resulting from the second embroidery design.

12. A processor platform as defined in claim 11, whether the microprocessor is further to move the first embroidery design from the first queue of designs to be embroidered by the first embroidery machine to a second queue of designs to be embroidered by the second embroidery machine, the microprocessor to perform the rolling back in response to the moving.

13. A processor platform as defined in claim 12, wherein the microprocessor is further to re-annotate the second embroidery design.

14. A processor platform as defined in claim 12, wherein the microprocessor is further to determine whether a first production time associated with the first embroidery machine is longer than a second production time associated with the second embroidery machine by at least a threshold amount, the moving the first embroidery design being in response to determining that the first production time is longer than a second production time by at least the threshold amount.

15. A processor platform as defined in claim 11, wherein the second embroidery design is referenced after the first embroidery design in the first queue.

* * * * *